US010273075B2

(12) United States Patent
Brantley

(10) Patent No.: US 10,273,075 B2
(45) Date of Patent: Apr. 30, 2019

(54) STACKABLE STORAGE DEVICE FOR HEADWEAR

(71) Applicant: Kellen Brantley, Miami, FL (US)

(72) Inventor: Kellen Brantley, Miami, FL (US)

( * ) Notice: Subject to any disclaimer, the term of this patent is extended or adjusted under 35 U.S.C. 154(b) by 0 days.

(21) Appl. No.: 15/661,833

(22) Filed: Jul. 27, 2017

(65) Prior Publication Data

US 2019/0031428 A1 Jan. 31, 2019

(51) Int. Cl.

| | |
|---|---|
| ***B65D 85/18*** | (2006.01) |
| ***B65D 21/02*** | (2006.01) |
| ***B65D 43/16*** | (2006.01) |
| ***B65D 43/24*** | (2006.01) |

(52) U.S. Cl.

CPC ..... *B65D 85/18* (2013.01); *B65D 21/023* (2013.01); *B65D 43/166* (2013.01); *B65D 43/24* (2013.01)

(58) Field of Classification Search

CPC .... B65D 85/18; B65D 21/023; B65D 43/166; B65D 43/24

USPC ..... 206/738

See application file for complete search history.

(56) References Cited

U.S. PATENT DOCUMENTS 5,603,558 A * 2/1997 Zimmer ..... A47B 81/00 206/566

2011/0100865 A1* 5/2011 Brink ..... A61C 19/02 206/581

2015/0321811 A1* 11/2015 Yeung ..... B65D 51/245 220/23.83

* cited by examiner

*Primary Examiner* — King M Chu

(74) *Attorney, Agent, or Firm* — Russell D. Nugent

(57) ABSTRACT

A storage device for headwear that includes an elongated container with side surfaces, top and bottom surfaces and a back surface that also features a drawer that can be slid in and out of the container through an opening at one end of the container. The opening is covered by a door featuring a magnet whose polarity is opposite that of another magnet embedded in the bottom surface of the container. The devices can be stacked one on top of another and magnets in the door of one device and the bottom surface of another device hold the door of one of the devices open. The container features one or more stops that contact the walls of the drawer to prevent it from being pulled out of the container. A horizontal flange limits the vertical movement of the drawer and cooperates with the stops to hold the drawer in place.

19 Claims, 4 Drawing Sheets

STACKABLE STORAGE DEVICE FOR HEADWEAR

BACKGROUND OF THE INVENTION (a) Field of the Invention

The present invention is in the technical field of apparel storage devices. More particularly, the present invention is in the technical field of storage devices for headwear.

(b) Background Art

Fashionable headwear is as much a part of Western fashion as are shoes, ties and suits. Baseball style caps have become increasingly popular over the generations. The precursor to the modern baseball cap was introduced to America as early as 1860 by the Brooklyn Excelsiors. By the turn of the twentieth Century, the Brooklyn style baseball cap had become popular among Americans. Early baseball caps were rather flimsy until Latex started being used to stiffen such hats giving birth to the modern baseball cap somewhere in the 1940s. Baseball caps are generally characterized by having an extended bill or brim in the front designed specifically to keep the sun out of the wearers eyes. In addition, modern baseball caps generally have a mesh material covering the back half or so of the garment to allow for air flow. Further, these hats generally have some means of adjusting the size of the hat in the back—usually either a plastic or hook and loop adjustment structure that allows the wearer to comfortably adjust the fit of the garment.

Baseball caps have become increasingly popular since their introduction and this style of headwear is probably the most popular style of headwear among Americans, particularly younger Americans, since more "formal" looking hats started to go out of style in the 1960s. These days, this style of headwear is used to feature a lot more than baseball team logos and can be used as marketing memorabilia, aka merchandising tools, for a whole host of endeavors from political campaigns to movie and video game promotions. There are a variety of reasons that cap enthusiasts wear this type of garment; for example, to complete a causal ensemble, to support a favorite team or cause and/or to cover up ones hair on a "bad hair day."

Cap enthusiasts often develop a collection of caps which will bring with it the problem of storing and displaying the caps. Currently, there are a number of devices on the market that are designed to store baseball caps, but none of them offer an easy way to (1) keep the caps free from dirt and dust, (2) display the caps to others and (3) allow the user to easily and conveniently access the individual caps. Moreover, the devices that are on the market are not structurally configured to stack one on top of another.

For example, a lot of devices revolve around some form of hanging rack with hooks for individual caps. However, these systems do not allow the user to store the caps in a compact form nor do they prevent the caps from collecting dust and dirt. Moreover, such a system does little to prevent the caps from falling off of the device onto the floor. Other storage devices consist of specialized hooks that are designed to support the inner surface of the cap racks that emulate shoe racks or trees. These devices suffer the same basic drawbacks that the previously described devices present.

Some of the storage devices on the market do consist of an enclosed structure that protects the cap collection from dust and dirt, but the devices are not sturdy enough to be stacked one on top of another. For example, there are devices consisting essentially of plastic bags with straps that allow the storage device to be hung up on a hook. The bags are usually opened and closed with a zipper or similar structure. This design requires the user to remove the plastic bag from the hook and place it on a flat surface before opening the bag and accessing a cap. Since the bags are flexible, they are not ideal display cases and certainly cannot be effectively stacked one on top of another.

As a result, there is a need for an improved storage device for headwear, caps included, that allows the user to display their collection in a dust and dirt-free environment in devices that can be stacked one on top of another and still allow the user to conveniently access the entire collection.

BRIEF SUMMARY OF THE INVENTION

The present invention is a storage device that allows a user to neatly store, display and access their collection of headwear or other garments in a clean, dust-free environment. The devices can be stacked to form an assembly of storage devices that cooperate to assist access to the headwear in that a first device stacked on top of a second device can be used to hold the door of the second device open while the user accesses the headwear inside.

Each individual storage device is made of a container that is preferably translucent if not transparent. In preferred embodiments, the container is an elongated container that has an interior and an exterior with a top surface, two side surfaces, a back surface and an opening at one end, preferably the end opposite or directly opposed to the back surface. In addition, preferred embodiments of each device include a moveable door that is positioned to cover the opening when it is closed and when it is opened, allowing the user access to the interior of the device.

In addition, preferred embodiments of the device feature a drawer located in the interior of each device. The drawer supports the user's collection of headwear garments while they are being stored and displayed inside each individual device and when the user wishes to access the headwear in the device. More specifically, the drawer is slidable, i.e., the user can pull the drawer partially out of the opening to the device while the drawer supports the individual pieces of headwear. Preferred embodiments of the device feature the drawer positioned on the bottom surface of the elongated container. Further, preferred embodiments of the drawer feature a front wall, a back wall and two side walls.

Furthermore, some preferred embodiments of the device feature structures that limit the movement of the drawer so that when the user slides the drawer out of the device, the drawer is held in place and prevented from tipping as a result of the weight of the individual garments. More specifically, the interior of the device features one or more structures such as a flange, ridge, rail or other protrusion on the interior surface of at least one if not both of the side surfaces of the container. When the drawer is slid partially out of the container, the weight of the headwear stored on the bottom of the drawer has a tendency to cause the portion of the drawer that is extended out of the opening to fall or tip downward thereby causing the opposite end of the drawer, including the back wall, to tip upwards. The side walls of the drawer thereby come into contact with the flanges or rails that are featured on side surfaces of the container. The flanges or rails thereby stop the upward movement of a portion of the drawer preventing the portion of the drawer that is extended out of the opening from continuing to tip downward.

Furthermore, if the user lifts the portion of the drawer that is extended out of the opening, that upward movement is also limited in that the portion of the drawer that is still inside the container contacts both the flanges and the bottom surface of the container. The flanges thereby prevent the user from accidentally raising the drawer to the point that the headwear stored on the drawer would be displaced.

Other embodiments of the device feature other structures that prevent the user from pulling the drawer all of the way out of the container. More specifically, the back wall of the drawer extends past the point where the drawer's side walls meet the drawer's back wall forming an extended portion. While it is possible to have a single extended portion featured only on one side or end of the back wall of the drawer, preferred embodiments feature an extended portion on either side of the back wall of the drawer. These extended portions are designed to engage with stops positioned on the interior of the container ideally on the bottom surface of the container when the user slides the drawer out of the opening. The combination of the stops and the extended portions thereby prevents the user from pulling the drawer completely out of the container, thus preventing the headwear from falling off of the drawer.

In addition, should the user need to pull the drawer fully out of the container, the shape of the flanges makes doing so possible. Each flange has three different portions—a back portion, a front portion and a bent portion. The back portion of the flange is the portion that is closer to both the bottom surface and the back surface of the container with respect to the front portion of the flange. The front portion of the flange is located closer to the top surface and opening of the container than the back portion of the flange. Joining the front portion and the back portion of the flange is the bent portion of the flange. Because the back portion of the flange is lower on the side surfaces of the container the bent portion of the flange extends away from the back portion at an obtuse angle to meet the front portion. Because the front portion of the flange is higher on the side walls than the back portion of the flange, there is more room or clearance between the back and side walls of the drawer and the front portion of the flange as compared with the back portion of the flange. As a result, when the user pulls the drawer out of the container and the extended portion of the drawer contacts the stop, the user can then lift the back half of the drawer over the stop by tilting the front half that is extended out of the container downward, thereby lifting the back end of the drawer up and over the stops.

There are other structures in the various embodiments of the device that both facilitate and take advantage of stacking of the devices one on top of the other. While not necessary to this function, it is desirable to include protrusions on the exterior of the device that engage with openings or holes located on the exterior of a second device. In preferred embodiments, there are protrusions located on the top surface of the device that are sized and positioned to engage holes featured in the bottom surface of a second device. The holes traverse the bottom surface of the device from the interior to the exterior of the device and allow the protrusions on the first device to engage with the second device such that the second device supports the first device. Other structures can be used to accomplish the same end, i.e. engaging the two devices to prevent the first or top device from falling or sliding off of the bottom or second device. For example, one device could feature slots on an exterior surface—either the top or the bottom surface—of the container; those slots being configured to accommodate or engage with ridges or protrusions on a corresponding surface of another device. In this manner, any number of devices could be stacked one on top of the other to form an assembly of storage devices.

The stackable nature of the devices also allows the devices to cooperate to make access to the individual pieces of headwear more convenient. Preferred embodiments of the elongated container feature a top surface that is shorter than the bottom surface. As a result of this length discrepancy, the side surfaces of the container slope downward from the edges of the top surface that are nearest the opening to the edges of the bottom surface that are also nearest the opening. It is possible for the sloping side walls to be featured on the opposite end of the device, but this arrangement is best featured by the front of the device, i.e., the end of the device that features the opening and the door. Generally, preferred embodiments of the device have side walls that slope downwards at an obtuse angle such as a 45 degree.

This shape becomes functional when a first device is stacked on top of a second device. In preferred embodiments, each of the devices features one or more magnets on the door and on the bottom surface of the container. The magnets are positioned such that when the door of the bottom device is opened fully, it contacts the bottom surface of the container of the device stacked above it. The magnets located in the door and the bottom surface of the container are thus positioned to contact, attract and temporarily adhere to each other. The door of the second or bottom device is thereby held open by the magnets located on either device. This configuration requires that the door feature hinges close to or integrated into the top surface of the container such that the lower surface of the door (the surface closest to the bottom surface of the container) is the free end of the door that can be lifted to reveal the opening in the container. Other embodiments can feature the hinge on the bottom edge of the door.

A variety of structures other than magnets can be used to allow the door to engage with and temporarily adhere to the bottom surface of the container stacked above. For example, the exterior of the door could be equipped with a fastening component of a hook and loop fastener system while the complementary fastening component of the same hook and loop fastener system could be located on the exterior of the bottom surface of the container stacked above. Similarly, hooks and grooves, and other conventional fasteners could be employed to accomplish the same end.

DETAILED DESCRIPTION OF THE INVENTION

Figure 1:
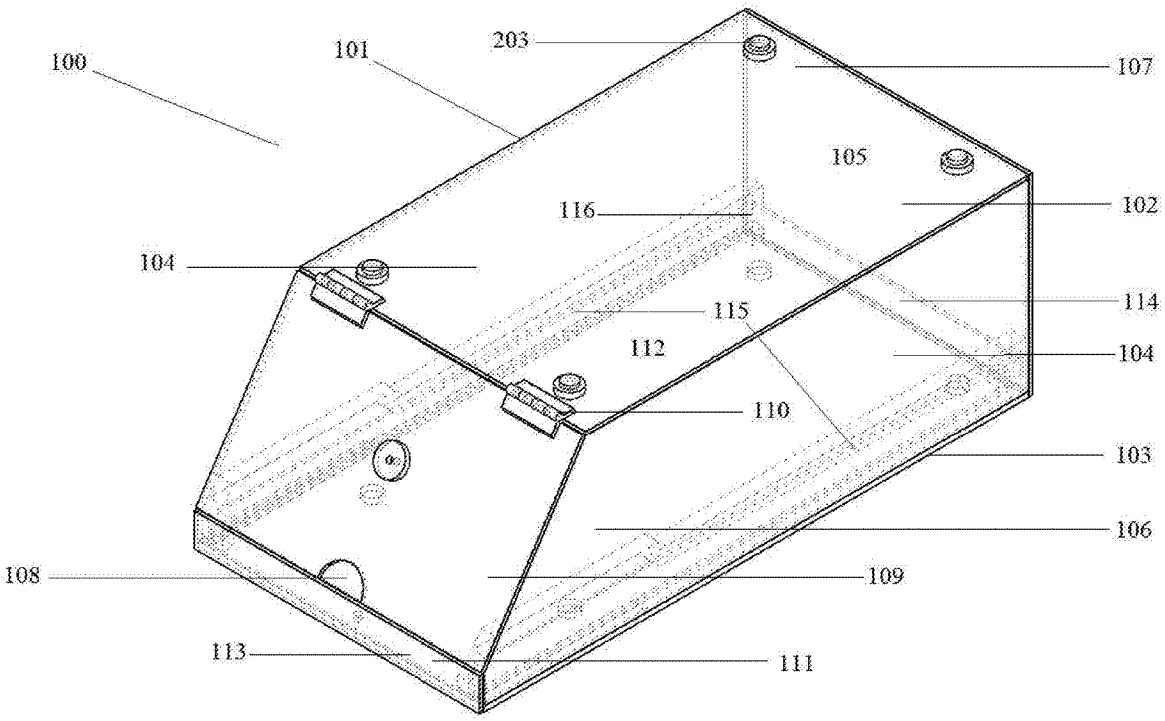
FIG. 1 is a top perspective view of a single stackable storage device with the door closed.

Referring now to the invention in more detail, in FIG. 1 there is shown a perspective view of the best mode of a single storage device with the door closed. As discussed above, each storage device unit, generally 100, is made of a container 101 with a slidable drawer 111. The container 101 is an elongated structure having a top surface 102, a bottom surface 103, two side surfaces 104, a back surface 105, an interior 106, an exterior 107 and an opening 108 covered by a door 109. In this embodiment, the door features hinges 110 at a top edge thereof that join the top edge of the door 109 to the top surface 102 of the container 101.

Figure 2:
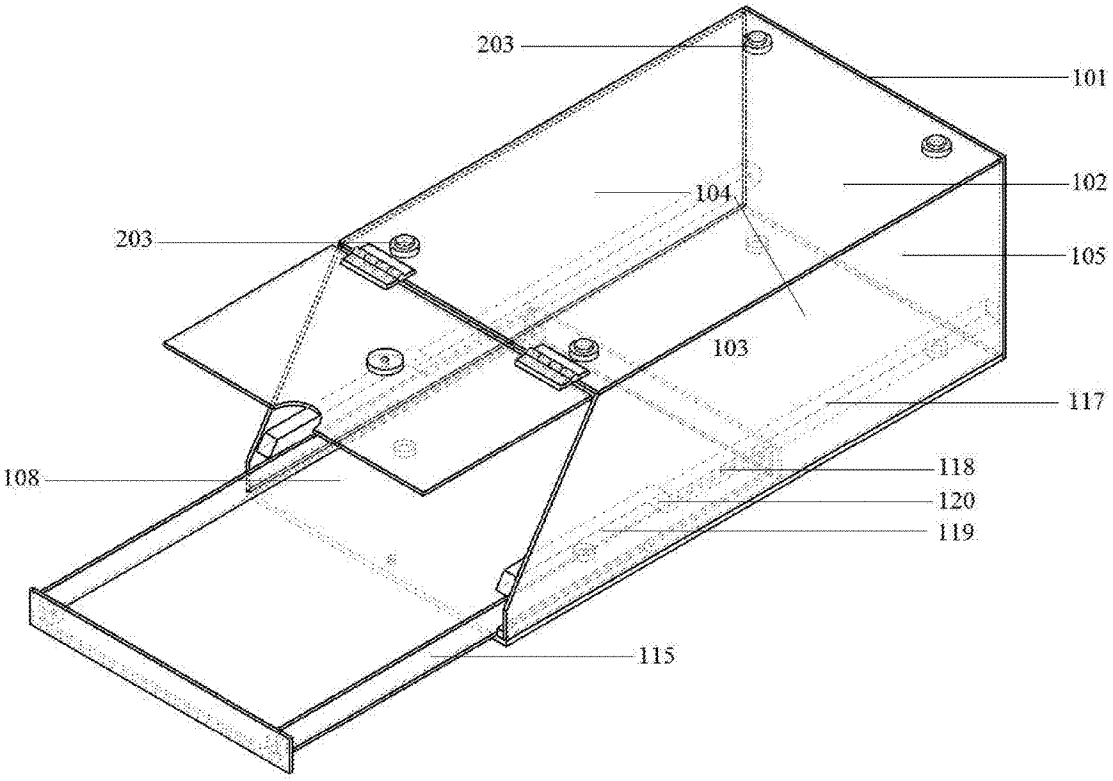
FIG. 2 is a top perspective view of a single stackable storage device with the door opened and the drawer extended out of the device.

Located within the container 101 is drawer 111. As shown in FIG. 2, the drawer 111 is positioned in the interior 106 of the container 101 to be able to slide in and out of the container 101 along the container's bottom surface 103. The drawer 111 is made up on a flat piece of material having a bottom 112 that is in contact with or located adjacent to the bottom surface 103 of the container 111. The drawer 111 also features a front wall 113, a back wall 114 and two side walls 115. In addition, the back wall 114 of the drawer 111 extends past the side walls 115 of the drawer 111 on the left and right side. This portion of the back wall 114 that extends past the side walls 115 on each side is referred to as the extended portion 116 of the drawer 111. Note that the width of the drawer 111 is a little bit less than the width of the container 101 to facilitate sliding the drawer 111 in and out of the container 101.

Referring again to the container 101 shown in FIGS. 1 and 2, the interior 106 of the container 101 features two flanges 117 on the side surfaces 104 of the container 101. In this embodiment, the location of the flanges 117 is less than an inch above the resting place of the side walls 115 of the drawer, but the distance between these structures can be varied, especially as the sizes of the various components of the device 100 are increased or decreased. Furthermore, the shape of the flanges 117 is worth noting. Each flange 117 can be described of as having three different portions. The back portion 118 of the flange 117 is the portion that is closer to both the bottom surface 103 and the back surface 105 of the container 101 with respect to the front portion 119 of the flange 117. The front portion 119 of the flange 117 is located higher on the side surfaces 104 of the container 101, i.e. it is closer to the top surface 102 and opening 108 of the container 101 than the back portion 118 of the flange 117. Joining the front portion 119 and the back portion 118 of the flange 117 is the bent portion 120 of the flange 117. Because the back portion 118 of the flange 117 is lower on the side surfaces 104 of the container 101 the bent portion 120 of the flange 117 extends from the back portion 118 at an obtuse angle to meet the front portion 119.

Still referring to the embodiment of the storage device 100 featured in FIGS. 1 and 2, the interior 106 of the container 101 also includes one or more stops 121 shaped, sized and positioned to engage with the extended portions 116 of the drawer 111. As previously noted, the stops 121 can be configured differently to engage with a different portion of the drawer 111. The inventor has determined through trial and error that the configuration shown in FIGS. 1 and 2 is one that works as well if not better than most other configurations. In the embodiment pictured in FIG. 1, each stop 121 is located in the interior 106 of the container 101 at the bottom edge of the side surfaces 104, i.e. the portion of the side surfaces 104 that are in contact with the bottom surface 103 of the container 101. In addition, this particular embodiment of the container 101 has the stops 121 located under the flange 117 where the bent portion 120 meets the front portion 119.

Referring back to the door 109 of the container 101, there is a magnet 122 integrated with or attached to the door 109. In addition, there is a magnet 123 (see FIG. 4) integrated with or attached to the bottom surface 103 of the container 101.

Figure 3:
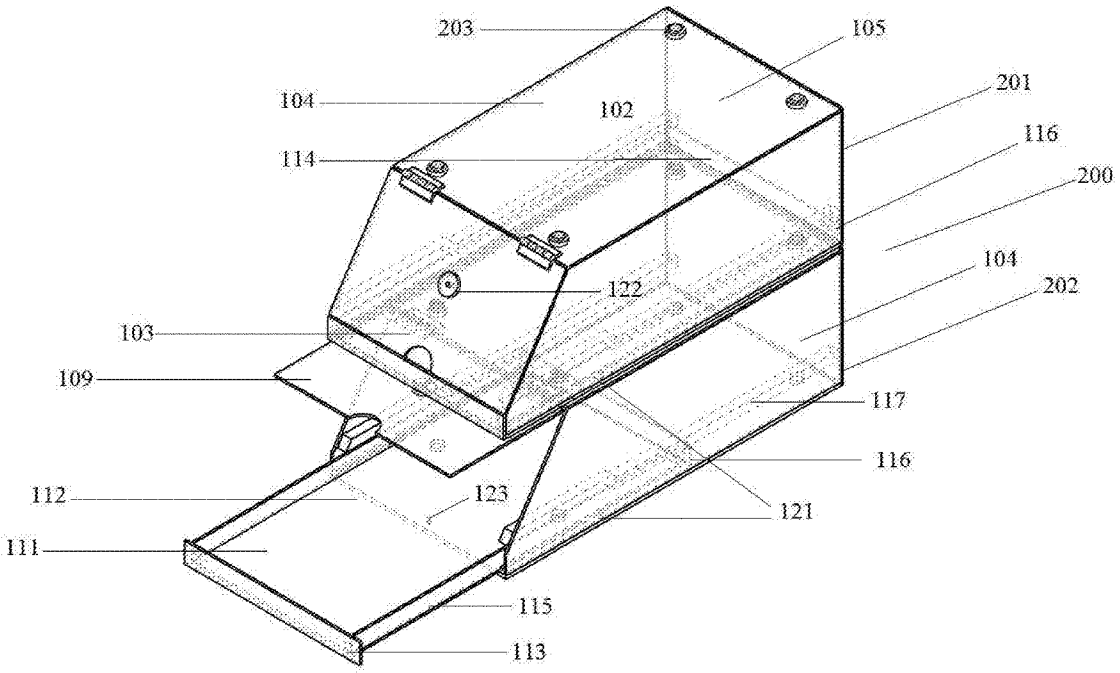
FIG. 3 is a top perspective view of two storage devices stacked one on top of another to form a storage assembly.

FIG. 3 illustrates a preferred embodiment of the storage device assembly 200. There is a first device 201 that is on top of a second device 202 forming a storage device assembly 200. Both the first device 201 and the second device 202 share the same structures in the best mode of the assembly 200; however, it is possible to vary the individual structures and produce an assembly 200 consisting of different embodiments of the device 100 stacked one on top of the other. The embodiment illustrated in FIG. 2 features at least two elongated containers 101 each having a top surface 102, a bottom surface 103, two side surfaces 104, a back surface 105, an interior 106, an exterior 107, an opening 108 and a moveable door 109. Further, each container 101 contains a slidable drawer 111 resting on or in contact with the bottom surface 103 on the interior 106 of the container. Each drawer 111 has a bottom 112, a front wall 113, a back wall 114 and two side walls 115. Moreover, preferred embodiments of the assembly include one or more horizontal flanges 117 located one or more of the side surfaces 104 in the interior 106 of the container 101. Each flange 117 has a back portion 118, a front portion 119 and a bent portion 120.

Still referring to the embodiment of the storage assembly 200 featured in FIG. 3, the interior 106 of the each container 101 also includes one or more stops 121 shaped, sized and positioned to engage with the extended portions 116 of the drawer 111. In addition, the back wall 114 of the drawer 111 extends past the side walls 115 of the drawer 111 on the left and right side. This portion of the back wall 114 that extends past the side walls 115 on each side is referred to as the extended portion 116 of the drawer 111. Note that the width of the drawer 111 is a little bit less than the width of the container 101 to facilitate sliding the drawer 111 in and out of the container 101.

To use the device, the user opens the door 109 and pulls on the front of the drawer 111 to slide the drawer 111 at least partially out of the container 101. The stops 121 located along the interior 106 of the container 101 will contact the extended portions 116 of the drawer 111 thereby preventing the user from pulling the drawer 111 all of the way out of the container 101. Should the user wish to pull the drawer 101 completely out of the container 101, they depress the front of the drawer 111 after it is extended partially out of the container 101 and in doing so they raise the portion of the drawer 111 featuring the back wall 114 and the extended portions 116 of the drawer 111. At that point, the user can continue pulling the drawer 111 out of the container 101 while lifting the extended portions 116 of the drawer 111 over the stops 121 that normally prevent the drawer 111 from sliding past a certain point. Next the user is free to place headwear on the drawer 111, slide the drawer 111 back into the container 101 and close the door 109. In this manner, the user can load and unload various garments into the device 100. Note, the shape of the flange 117 allows the back wall 114 of the drawer 111 to be lifted up over the stops 121 that normally prevent the drawer 111 from coming completely out of the container 101.

Figure 4:
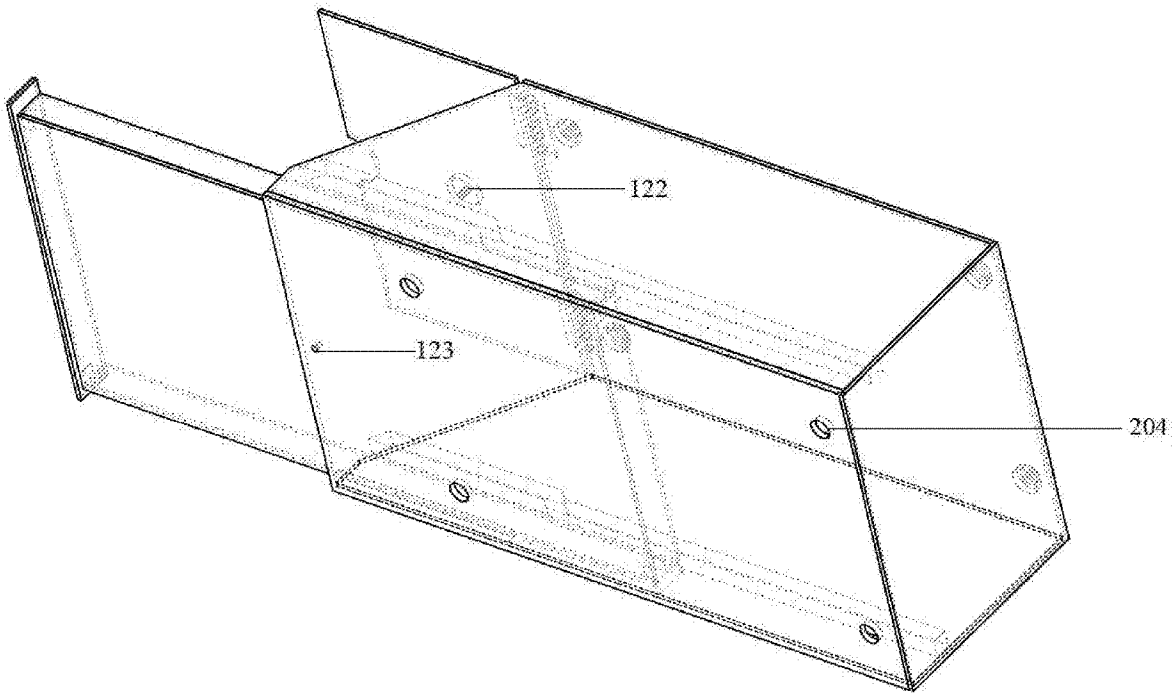
FIG. 4 is a bottom perspective view of a single stackable storage device with the door opened and the drawer extended out of the device.

As previously discussed, two or more devices 100 can be stacked one on top of another to produce a storage assembly 200. FIGS. 1 and 2 show protrusions 203 featured on the exterior of the top surface 102 of each container 101. These protrusions 203 are complementary to holes 204 that present in the bottom surface 112 of the drawer 111 as shown in FIG. 4. The engagement of these protrusions 203 and holes 204 helps to stabilize the first device 201 on top of the second device 202, i.e. preventing the first device 201 from sliding off of the second device 202. Once the first device 201 is stacked on top of the second device 202, the door 109 of the second device 202 can be opened. When that door 109 is opened all of the way, it comes into contact with the bottom surface 103 of the first device 201 that features a magnet 123. The magnet 122 on the door 109 is attracted to the magnet 123 on the bottom surface 103 of the first container 201 and is held open while the user accesses the second device 202. When the user opens the door 109 of the first device 201 all of the way, the door 109 can swing back onto the top surface 102 of the first container 201. In this manner, two or more devices 100 can be stacked on top of one another so that the user can display their collection of headwear and easily access any piece of headwear in either device 100 without having to hold the doors 109 open by hand.

The presently disclosed device has a number of advantages over the prior art. In particular, preferred embodiments of the storage assembly allow the user to display their collection of headwear in a clean environment, to prevent the headwear from becoming dusty or dirty and at the same time to display the headwear in an attractive manner. In addition, the storage devices allow the user to easily access all of the pieces of headwear. Further, the devices when stacked one on top of the other devices assist each other in holding the door to the opening open, making access to the headwear more convenient. The devices also allow the user to stack a large number of headwear pieces in one container. These and other advantages represent a significant departure from the existing headwear storage devices.

Reference throughout the specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussion of the features and advantages, and similar language, throughout the specification may, but do not necessarily, refer to the same embodiment.

Furthermore, the described features, advantages, and characteristics of the invention may be combined in any suitable manner in one or more embodiments. One skilled in the relevant art will recognize that the invention can be practiced without one or more of the specific features or advantages of a particular embodiment. In other instances, additional features and advantages may be recognized in certain embodiments that may not be present in all embodiments of the invention.

It is understood that the above described embodiments are only illustrative of the application of the principles of the present invention. The present invention may be embodied in other specific forms without departing from its spirit or essential characteristics. The described embodiment, including the best mode, is to be considered in all respects only as illustrative and not restrictive. The scope of the invention is, therefore, indicated by the appended claims, if any, in conjunction with the foregoing description.

While the foregoing written description of the invention enables one of ordinary skill to make and use what is considered presently to be the best mode thereof, those of ordinary skill will understand and appreciate the existence of variations, combinations, and equivalents of the specific embodiment, method, and examples herein. The invention should therefore not be limited by the above described embodiment, method, and examples, but by all embodiments and methods within the scope and spirit of the invention.

I claim:

1. A stackable storage device for headwear comprising:

an elongated container with a top surface, a bottom surface, two side surfaces, a back surface, an interior, an opening and a moveable door positioned to cover the opening when closed; wherein the top surface is shorter in length than the bottom surface; and an end of each of the side surfaces slopes down from the top surface to the bottom surface at an obtuse angle;

a slidable drawer having a bottom, a front wall, a back wall and two side walls, the drawer being located in the interior of the container on the bottom surface of the container; and a horizontal flange located on each side surface in the interior of the container and positioned to contact the side walls of the drawer when the back wall of the drawer is raised.

2. The stackable storage device of claim 1 wherein the horizontal flange has a back portion, a bent portion and a front portion; wherein the bent portion extends away from the back portion of the flange toward the top surface of the container at an obtuse angle.

3. The stackable storage device of claim 2 wherein at least one stop is located directly underneath a point on the horizontal flange where the bent portion meets the front portion.

4. The stackable storage device of claim 1 further comprising a first magnet featured on the door and a second magnet located on the bottom of the container adjacent to the opening.

5. The stackable storage device of claim 1 further comprising:

two extended portions featured on the back wall of the drawer and that protrude past a point where each of the side walls connects to the back wall; and the interior of the container features at least two stops positioned to contact the two extended portions of the drawer as the drawer slides along the bottom surface of the container.

6. The stackable storage device of claim 5 wherein the horizontal flange has a back portion, a bent portion and a front portion; wherein the bent portion extends away from the back portion of the flange toward the top surface of the container at an obtuse angle.

7. The stackable storage device of claim 6 wherein the stops are located directly underneath a point on the horizontal flange where the bent portion meets the front portion.

8. The stackable storage device of claim 7 further comprising a first magnet featured on the door and a second magnet located on the bottom of the container adjacent to the opening.

9. The stackable storage device of claim 6 further comprising a first magnet featured on the door and a second magnet located on the bottom of the container adjacent to the opening.

10. The stackable storage device of claim 1 further comprising two extended portions featured on the back wall of the drawer and that protrude past a point where each of the side walls connects to the back wall; and the interior of the container features at least two stops positioned to contact the two extended portions of the drawer as the drawer slides along the bottom surface of the container.

11. A stackable storage device for headwear comprising:

an elongated container with a top surface, a bottom surface, two side surfaces, a back surface, an interior, an opening and a moveable door positioned to cover the opening when closed;

a slidable drawer having a bottom, a front wall, a back wall and two side walls, the drawer being located in the interior of the container on the bottom surface of the container;

a horizontal flange located on each side surface in the interior of the container and positioned to contact the side walls of the drawer when the back wall of the drawer is raised; and at least one stop located in the interior of the container and positioned to engage with the drawer as it slides along the bottom surface of the container.

12. The stackable storage device of claim 11 wherein the horizontal flange has a back portion, a bent portion and a front portion; wherein the bent portion extends away from the back portion of the flange toward the top surface of the container at an obtuse angle.

13. The stackable storage device of claim 12 wherein the top surface is shorter in length than the bottom surface; and an end of each of the side surfaces slopes down from the top surface to the bottom surface at an obtuse angle.

14. The stackable storage device of claim 11 further comprising two extended portions featured on the back wall of the drawer and that protrude past a point where each of the side walls connects to the back wall; and the interior of the container features at least two stops positioned to contact the two extended portions of the drawer as the drawer slides along the bottom surface of the container.

15. A stackable storage assembly for headwear comprising:

at least two elongated containers each comprising:

a top surface, a bottom surface, two side surfaces, a back surface, an interior, an opening and a moveable door positioned to cover the opening when closed; wherein the top surface is shorter in length than the bottom surface; and an end of each of the side surfaces slopes down from the top surface to the bottom surface at an obtuse angle;

a first magnet featured on the door and a second magnet located on the bottom of the container adjacent to the opening;

a slidable drawer having a bottom, a front wall, a back wall and two side walls, the drawer being located in the interior of the container on the bottom surface of the container; and a horizontal flange located on each side surface in the interior of the container and positioned to contact the side walls of the drawer when the back wall of the drawer is raised.

16. The stackable storage assembly of claim 15 wherein the top surfaces of each container feature a plurality of protrusions complementary to a plurality of holes that traverse the bottom surfaces of the containers from an exterior of the containers to the interiors of the containers.

17. The stackable storage assembly of claim 16 wherein at least one horizontal flange has a back portion, a bent portion and a front portion; wherein the bent portion extends away from the back portion of the flange toward the top surface of the container at an obtuse angle.

18. The stackable storage assembly of claim 17 further comprising two extended portions featured on the back wall of each drawer that protrude past a point where each of the side walls of the drawers connect to the back wall of the drawers; and the interior of the container features at least two stops positioned to contact the two extended portions of each drawer as each drawer slides out of their respective openings.

19. The stackable storage assembly of claim 18 wherein each of the stops in each device are located directly underneath a point on the horizontal flanges where the bent portions meet the front portions.

* * * * *